US008556563B2

(12) United States Patent
Marsh

(10) Patent No.: US 8,556,563 B2
(45) Date of Patent: Oct. 15, 2013

(54) ADHESIVE APPLICATOR FOR PERFECT BOUND BOOKS AND METHOD OF APPLYING ADHESIVE

(75) Inventor: Jeffrey D. Marsh, Foristell, MO (US)

(73) Assignee: Perfect Systems, LLC, Foristell, MO (US)

( * ) Notice: Subject to any disclaimer, the term of this patent is extended or adjusted under 35 U.S.C. 154(b) by 819 days.

(21) Appl. No.: 12/696,806

(22) Filed: Jan. 29, 2010

(65) Prior Publication Data

US 2011/0188972 A1 Aug. 4, 2011

(51) Int. Cl.
*B42C 9/00* (2006.01)

(52) U.S. Cl.
USPC ..... 412/8; 118/244; 118/411; 118/118; 118/429; 118/578; 118/323; 412/37; 399/407; 399/408

(58) Field of Classification Search
USPC ..... 118/244, 411, 118, 429, 578, 323; 412/37, 8; 399/407, 408
See application file for complete search history.

(56) References Cited

U.S. PATENT DOCUMENTS

| | | | | |
|---|---|---|---|---|
| 4,556,353 | A | 12/1985 | Ehlermann | |
| 5,108,244 | A | 4/1992 | Bellanca | |
| 5,271,794 | A * | 12/1993 | Jarrell et al. | 156/578 |
| 5,465,213 | A | 11/1995 | Ross | |
| 5,988,620 | A | 11/1999 | Graushar | |
| 6,012,890 | A | 1/2000 | Celorio Garrido | |
| 6,142,721 | A | 11/2000 | Marsh | |
| 6,193,458 | B1 | 2/2001 | Marsh | |
| 6,206,358 | B1 | 3/2001 | Yamaguchi et al. | |
| 6,213,703 | B1 | 4/2001 | Garrido | |
| 6,416,082 | B1 | 7/2002 | Gayoso | |
| 6,460,843 | B1 | 10/2002 | Dim et al. | |
| 6,881,443 | B2 * | 4/2005 | Baltensperger | 427/208.6 |
| 6,928,914 | B2 | 8/2005 | Marsh | |
| 7,014,182 | B2 | 3/2006 | Marsh | |
| 7,963,733 | B2 * | 6/2011 | Marsh | 412/37 |
| 7,970,340 | B2 * | 6/2011 | Sorita et al. | 399/408 |
| 8,281,736 | B2 * | 10/2012 | Tsuchiya et al. | 118/244 |

(Continued)

FOREIGN PATENT DOCUMENTS

JP S61-97795 5/1986

OTHER PUBLICATIONS

BQ-150 Book Binder Brochure, Published prior to Aug. 18, 2008.

(Continued)

*Primary Examiner* — Dana Ross
*Assistant Examiner* — Mohammad Nourbakhsh
(74) *Attorney, Agent, or Firm* — Polster, Lieder, Woodruff & Lucchesi, L.C.

(57) ABSTRACT

An adhesive applicator is disclosed for the application of a hot melt adhesive to the spine of a book block so as to adhesively bind the book block to its respective cover so as to form a perfect bound book. The applicator has a heated head in which a small quantity of a hot melt adhesive sufficient to bind at least one book block to its cover is quickly heated to a temperature such that it may be applied to the spine. The head is brought into operative engagement with the spine and is moved with respect to the spine so that the melted adhesive forced (dispensed) out of the head onto the spine. This applicator is particularly well suited for use with print on demand book printing and binding apparatus. A method of applying the adhesive to the spine of a book block is also disclosed.

34 Claims, 10 Drawing Sheets

(56) References Cited

U.S. PATENT DOCUMENTS

| | | | |
|---|---|---|---|
| 2006/0029445 | A1 | 2/2006 | Nakamura et al. |
| 2007/0035081 | A1 | 2/2007 | Kaneko et al. |
| 2007/0036637 | A1 | 2/2007 | Hata et al. |
| 2007/0045920 | A1 | 3/2007 | Yoshie et al. |
| 2007/0122256 | A1 | 5/2007 | Toyoizumi et al. |

OTHER PUBLICATIONS

Nordson Brochure Entitled "Universal Modules Maximize Dispensing Performance," published prior to Jan. 1, 2009.

Nordson Brochure Entitled "GP200 Remote Metering Stations," published prior to Jan. 1, 2009.

* cited by examiner

ADHESIVE APPLICATOR FOR PERFECT BOUND BOOKS AND METHOD OF APPLYING ADHESIVE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE DISCLOSURE

Perfect binding is in widespread use in the publishing business for a wide variety of books. Typically, perfect bound books have a book block comprised of a multiplicity of text pages with a cover adhesively bound to the spine of the book block. The number of text pages comprising the book block may vary considerably, as discussed below. Typically, the cover is of a heavier paper stock (or other suitable material, e.g., a plastic film or the like) than the text pages of the book. Print on demand perfect bound books are now coming into widespread use. Apparatus, such as described in my U.S. Pat. Nos. 6,193,458, 6,443,682 and 7,014,182, and in U.S. Pat. No. 5,465,213, describe known prior art print on demand book publication systems and methods where the resulting books are perfect bound.

As described in my above-noted prior art patents, after the text pages have been printed and accumulated to form a book block, the book block is transported to an adhesive application station where a hot melt adhesive is applied to the spine of the book block. Typically, a reservoir of the adhesive (referred to as a glue pot) is heated to a relatively high temperature, for example ranging between about 325° F. (or lower) and about 375° F. (or higher), depending on the characteristics of the adhesive being used. A rotary driven drum (or wheel) is at least partially submerged in the melted adhesive in the glue pot. As the spine of the book is transported to the adhesive application station, the drum is rotated so as to pick up molten adhesive on the peripheral face of the drum. The drum thus has a coating of the molten adhesive on the periphery of the drum. A wiper bar may be used to wipe off excess adhesive on the periphery of the drum as the latter rotates so as to insure that the layer of adhesive on the face of the drum is of a desired uniform thickness. As the book block is moved past the adhesive application station, the spine of the book contacts (or nearly contacts) the upper reach of the drum and a layer of adhesive is applied to the spine of the book. Such glue pots and rotary drums have been in widespread use in perfect binding systems for many years. While this prior method of applying holt melt adhesive to the spine of the book block in the manufacture of so-called "print on demand" perfect bound books has worked satisfactorily, many disadvantages have been noted, as discussed below.

In the production of a perfect bound book that is printed on demand by apparatus such as shown in my above-noted U.S. patents, it is oftentimes desired that the book be printed and bound within a short time after it is ordered (i.e., commanded to be printed) by the operator or by a customer or even by another computer. If the print on demand apparatus has not been previously warmed up, it will take a considerable time (e.g., 20-50 minutes) to heat the adhesive in the glue pot to a temperature sufficient to properly adhesively bond the book block to the cover. Such a long delay has been objectionable when the glue pot method is employed in a print on demand book printing and binding system. In addition, it has been found that the quality of the binding is quite sensitive to the temperature of the adhesive in the glue pot at the time the adhesive is applied to the spine of the book, to the level of adhesive in the glue pot, and to the length of time that the adhesive has been heated.

It will be appreciated by those of ordinary skill in the art that hot melt adhesives are complex organic chemical mixtures containing compounds of various molecular weights where such compounds may have different melting temperatures and different volatility characteristics. As the adhesive is held at elevated temperatures for extended periods of time, some of the lower molecular weight and more volatile compounds in the adhesive may evaporate thus changing the makeup of the adhesive and changing its ability to properly bond the spine of the book to the cover. Also, as adhesive is consumed in binding of books, additional room temperature adhesive (typically in the form of pellets or small briquettes) must be added to the glue pot. This is typically manually done by the operator. If the level of the molten adhesive in is too low, the rotary drum will not pick up a sufficient layer of adhesive on its face and/or the adhesive may not be sufficiently heated so as to result in a satisfactory binding of the cover to the spine of the book.

Also, because the adhesive in the glue pot is oftentimes kept at its application temperature for extended periods of time, the heated adhesive will tend to give off fumes and/or unpleasant odors. While such fumes and/or odors may not be objectionable in a factory setting, if a print on demand book printing and binding apparatus is utilized in a bookstore or in a library, the emission of such fumes and odors may be problematic. It is also recognized that in an industrial setting, ventilation systems may be used to collect and vent such odors or fumes, but requirement of a special ventilation systems would be difficult and expensive to provide for most print on demand applications.

It has also been found that in order to produce a consistent binding of the book block to the cover the adhesive must wet both the edges of the text pages making up the spine of the book block and a small portion of the face of the outside pages of the book block proximate the spine. This has been difficult to do with the above-described glue pot and rotary drum.

Further in the use of the above-described glue pot and rotary drum, there are many parameters that affect the quality of the binding operation. As noted, the adhesive must be heated to the proper temperature and the quality of the binding is sensitive to adhesive temperature. Thus, the temperature of the adhesive must be maintained within a narrow temperature range (e.g., 350° F., plus or minus 25° F.) of the desired temperature. Also the rotational speed of the drum must be substantially matched to the speed that the book block spine is moved past the drum. If the book spine is moved too fast relative to the surface speed of the drum, a sufficient quantity of adhesive may not be applied to the spine. If the book spine is moved too slowly, excess adhesive may be applied, which may result in the still molten excess adhesive running onto areas of the book block or cover (when the book block is clamped to the cover) as to make an unacceptable book.

In my U.S. Pat. No. 6,142,721, another adhesive application system is disclosed in which a hot melt adhesive is applied while in an unheated or solid state to either to the spine or to the cover in the area that the spine is to be bound to the cover. Then, as the cover is tightly clamped to the spine in close proximity to the spine, an ultrasonic transducer is brought into operative contact with the outside of the cover in the area of the spine and rendered resonant so as to almost instantly heat the adhesive and to effect binding of the cover to the spine of the book block. While this ultrasonic binding method has worked well, such ultrasonic transducer and the required power supply are complex and expensive.

Thus, there has remained a longstanding problem of providing apparatus and a method of utilizing hot melt adhesive for the perfect binding of a book block to a cover in a print on demand book printing and binding apparatus that avoids the above-discussed shortcomings of the prior art.

BRIEF SUMMARY OF THE DISCLOSURE

Briefly stated, the apparatus of this disclosure applies a coating of a hot melt adhesive to the spine of a book block of a book so that the book block may have a cover adhesively bound thereto. The book block is held in a clamped position with the spine exposed. The adhesive applying apparatus has a head. The book block and the head are movable relative to one another along a path substantially parallel to the spine of the book block for a distance approximately the length of the spine. Further, the head and the book block are movable toward and away from one another between an adhesive applying position in which the head is in operative relation with the spine so as to apply the adhesive to the spine and a retracted position in which the head is clear of the spine. The head has one or more heaters therein for melting the adhesive. The adhesive is fed into the heater to be melted within the head. A drive for feeding the adhesive into the head is provided so as to dispense the melted adhesive from an opening in the head onto the spine of a book block as the book block and the head are moved relative to one another along said path so as to insure that an adequate supply of melted adhesive is available so as to be applied to the spine of a next the book block.

Additionally, the apparatus disclosed herein is intended to apply adhesive to the spine of a book block for adhesively binding a cover to the book block where the thickness of the book block may vary within a limited range from a maximum thickness to a minimum thickness. More specifically, the apparatus comprises a head having an end face adapted to be operatively associated with the spine of a book block so that upon relative movement between the book block and the head applies a layer of adhesive to the spine of the book block. A heater is provided in the head for heating the adhesive to a temperature sufficient to effect application of the adhesive to the spine of the book block. A supply of solid adhesive is forcibly fed to the head so as to be melted by said heater and so as to dispense melted adhesive from the head and onto the spine of a book block. A slot (or other opening) is provided in the end face of the head with one portion of the head end face on one side of the slot extending axially relative to the head out beyond another portion of the head end face on the opposite side of the slot for operative engagement with the spine of the book block. The head end face has one portion that leads the slot with respect to the direction of relative movement between the book block and the head and another portion of the head end face which is stepped back from the spine of the book block and from the one portion. The slot is in communication with the melted adhesive within the head. The head is rotatable about an axis substantially perpendicular to the end face of the head between a first position in which the slot is oriented in a first position with respect to the spine and a second or angled position in which the slot is angled with respect to the spine. The slot is of a length sufficient so as to extend across substantially the thickness of the spine of the maximum thickness book block when the head is in its first position. Upon application of the adhesive to a book block having a thickness less than the maximum thickness of the spine, the head is rotatable from the first position to its second or angled position in which the slot extends diagonally across substantially the full thickness of the book block so as to apply the adhesive to the spine of the last-the book block.

In accordance with this disclosure a method of applying a adhesive to the spine of a book block for perfect bound books is disclosed so that the book block may be adhesively bound to a respective paper cover where the thickness of the spine of the book block may vary within a limited range between a maximum thickness and a minimum thickness. This method comprises providing a head for applying adhesive to the spine, providing a supply of adhesive, heating the adhesive within the head to a temperature sufficient that the adhesive flows, providing a slot (or other opening) in the end face of the head, and forcing the heated adhesive from the head when the latter is in operative relation with the spine so that the flowable adhesive is dispensed from the slot onto the spine as the head and book block are moved relative to one another. If the thickness of the spine is less than the maximum thickness of the book block, the head is rotated from an initial position in which the slot extends across the spine so as to accommodate spines of a maximum thickness to an angled position in which the slot extends diagonally across the thickness of the spine. Then, movement is effected between the head and the book block so that the head moves along the length of the spine so that a layer of adhesive is applied to the length of the spine.

BRIEF DESCRIPTION OF THE SEVERAL VIEWS OF THE DRAWINGS

Corresponding reference characters indicate corresponding parts through out the several views of the drawings.

DETAILED DESCRIPTION OF PREFERRED EMBODIMENTS

Figure 1:
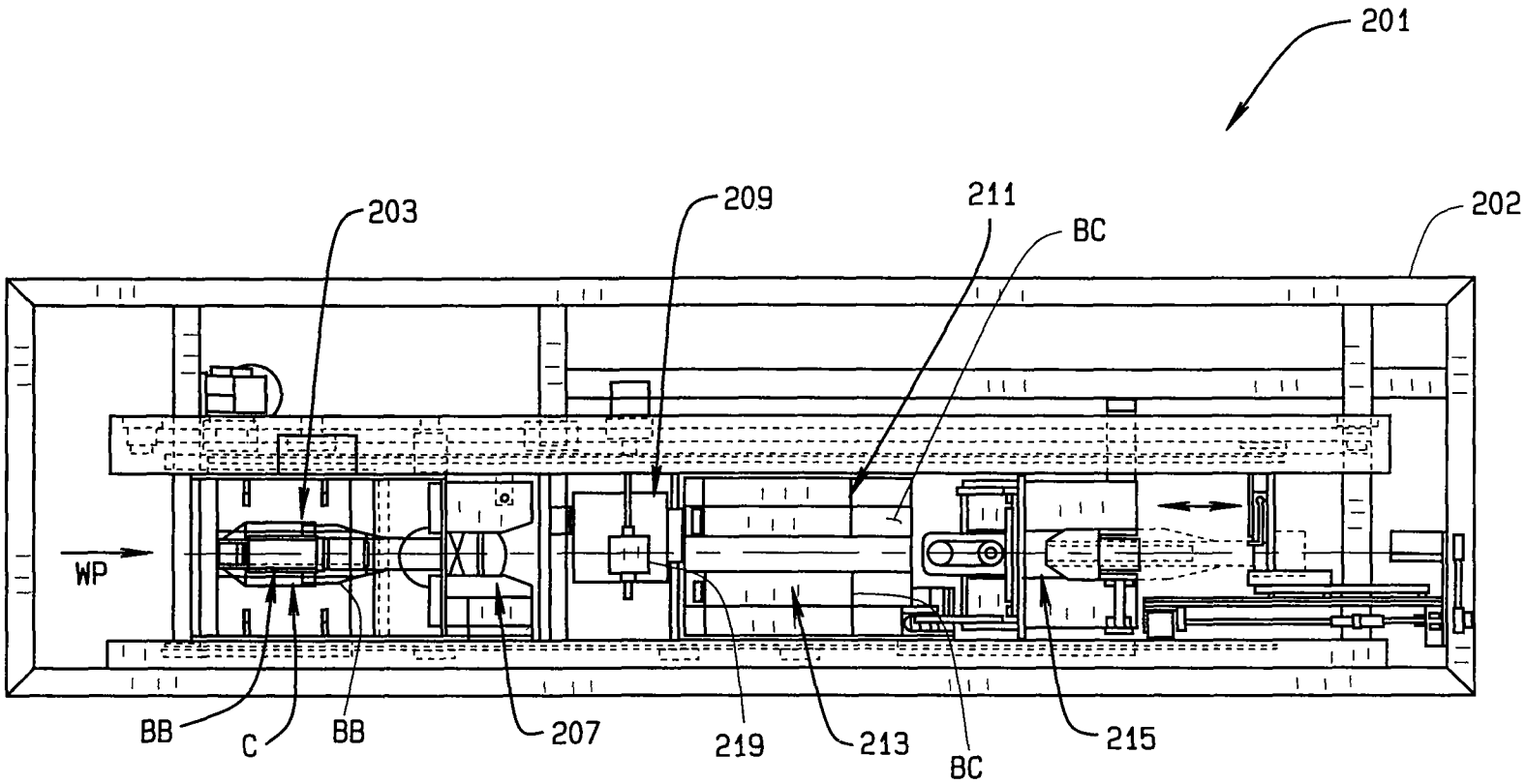
FIG. 1 PRIOR ART
FIG. 1 is a top plan view of a print on demand book printing, binding, and trimming apparatus, such as described in my prior U.S. Pat. No. 7,014,182, showing the location of a prior art glue applicator utilizing a rotary drum for applying hot melt adhesive to the spine of a book block immediately prior to the book block being adhesively bound to a cover, where the adhesive applicator of the present disclosure may be substituted for such prior art glue applicator, or where the adhesive applicator of the present disclosure may be located at other locations in relation to the apparatus depicted.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Additionally, it is to be understood that the invention described by the Claims of this disclosure is not limited in its application to the details of construction and the arrangements of components set forth in the following description or illustrated in the drawings.

Figure 2:
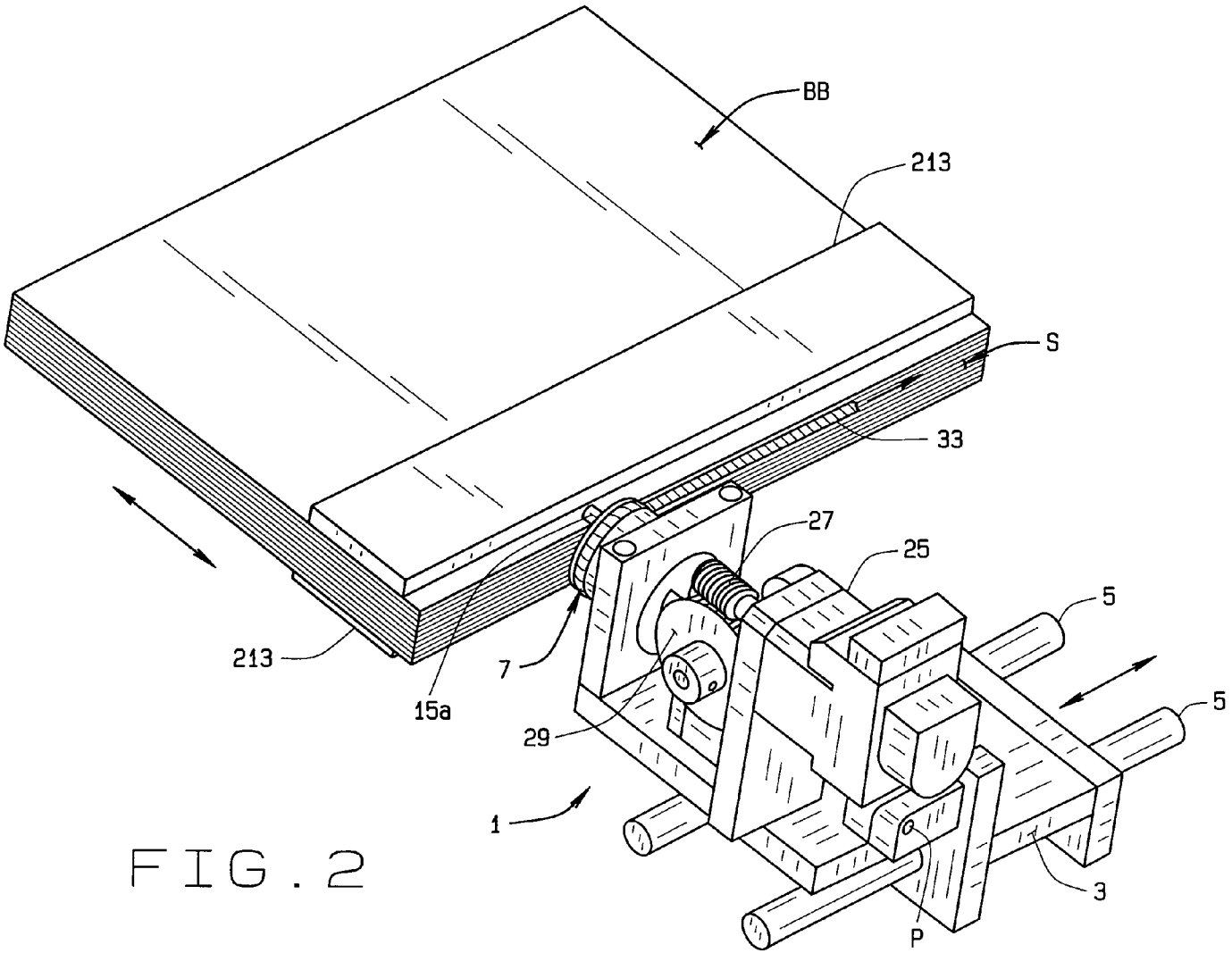
FIG. 2 is a perspective view of the adhesive applicator of this disclosure shown to be movable along rails parallel to the spine of a book block to which the applicator is to apply adhesive.

Referring now to the drawings and particularly to FIG. 1, a prior art apparatus for binding and trimming perfect bound books is illustrated in its entirety at 201. Apparatus 201 is similar to the apparatus disclosed in my prior U.S. Pat. Nos. 6,193,458 and 7,014,182, which are herein incorporated by reference. As shown in FIG. 1, this prior apparatus has a frame 202 with a carriage C (or other fixture) movable along a track or work path WP from a first position 203 at the left-hand portion of FIG. 1 at which a book block BB is deposited in carriage C. As shown in FIG. 1, the carriage C may be movable along a horizontal work path. However, as described in my pending U.S. patent application Ser. No. 12/576,923, filed Oct. 9, 2009 and incorporated by reference in its entirety herein, the book block may deposited in an inclined accumulator which then is rotated to a vertical position and then moved vertically to an adhesive application station. The description of the book block BB is described in my above-noted patents. As shown in FIG. 2, the book block BB has a plurality of text pages of a book arranged in a rectangular stack or block with one edge (typically a major edge) of the book block constituting a spine S. The number of pages and thus the thickness of the book block may vary between a minimum and a maximum thickness. In general, but not as a limitation, it becomes difficult to perfect bind fewer than about 25 pages and book blocks having a thicknesses greater than about 2½-3 (or more) inches. However, it will be understood that these book block thicknesses are not limitations to the apparatus and methods disclosed herein such that within the broad scope of this disclosure all perfect bound books may be bound in accordance with the apparatus and methods herein disclosed. The carriage C has a clamp for holding the pages of the book block as the carriage moves along work path WP from one position therealong to another. The details of the carriage, the carriage clamp, and the drive for moving the carriage along the work path WP are described in my above-noted U.S. patents and pending patent application, which are incorporated by reference, and for the sake of brevity are not repeated in this disclosure. As noted in the afore-mentioned patents, the book block is oriented in carriage C in a generally vertical position with its spine S exposed beneath the carriage. However, the orientation of the book block need not be vertical, but rather may be at any desired orientation or position. As shown in FIGS. 2-10, the book block is depicted in a horizontal position, but it will be understood that the book block could be in any desired position or orientation, including vertical.

Figure 6:
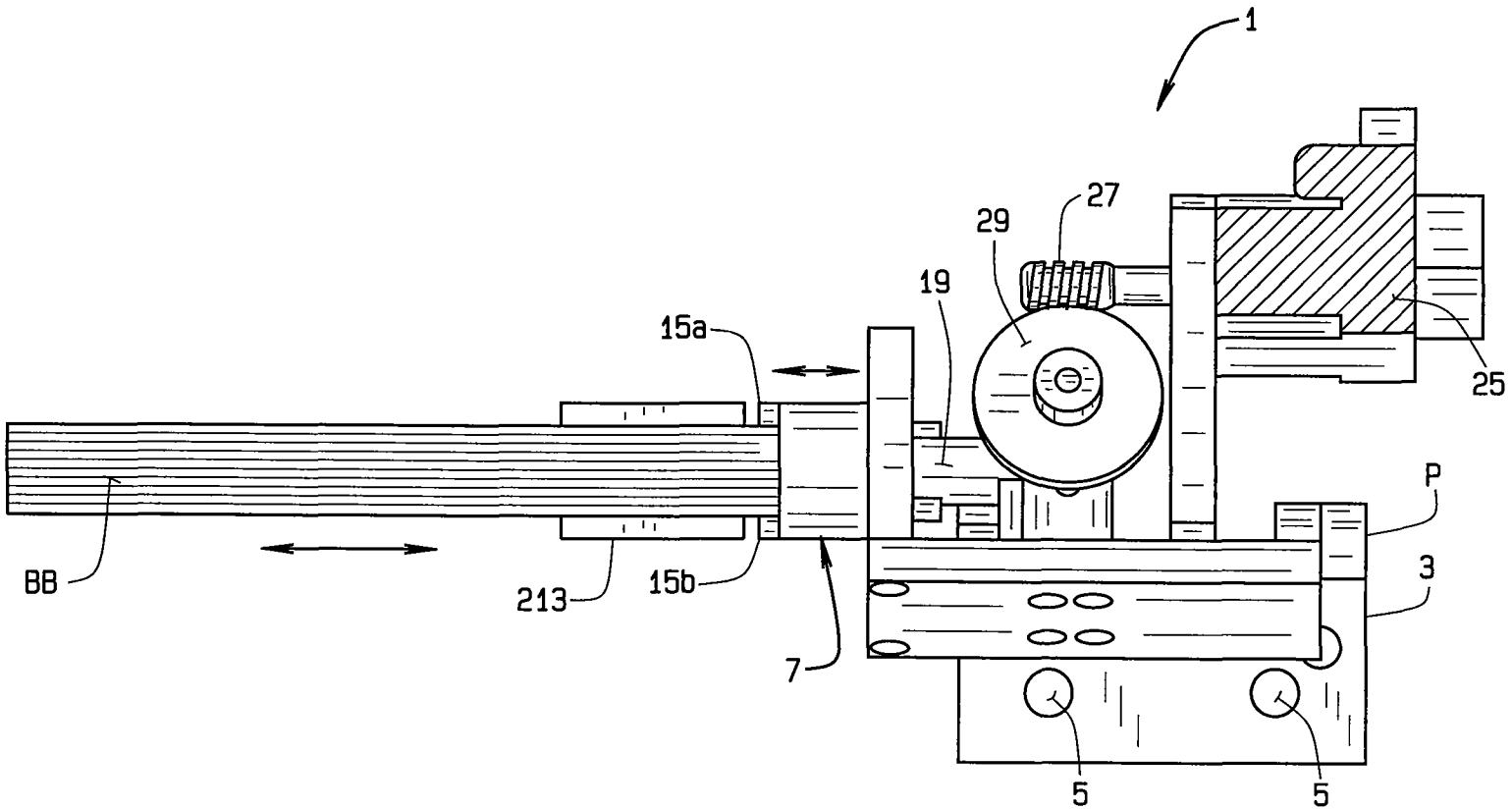
FIG. 6 is another side elevational view of the applicator in its operative position with the applicator tilted with respect to the book block spine with the stops or gage pins in engagement with the top and bottom faces of the book block proximate the spine.
Figure 7:
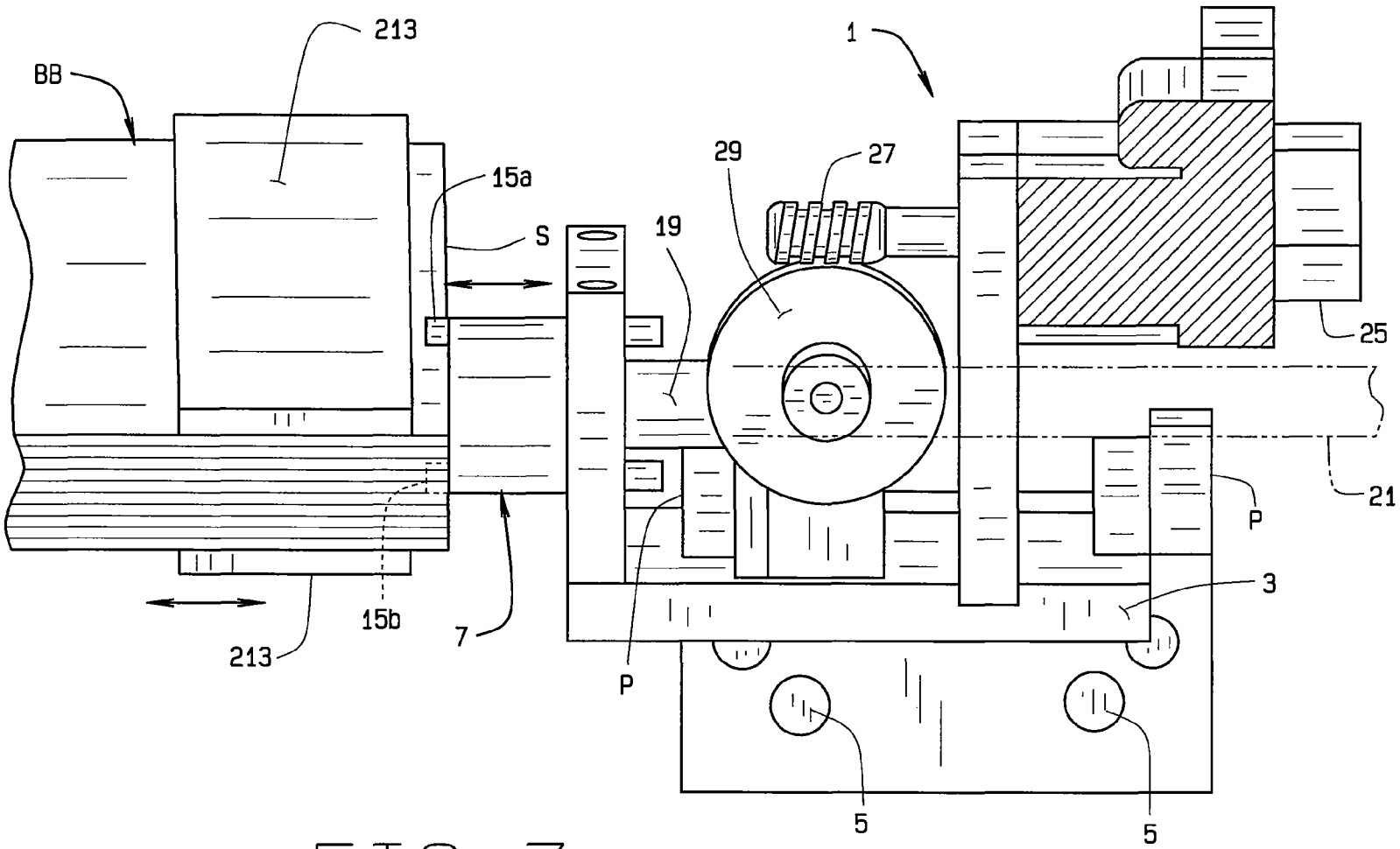
FIG. 7 is an enlarged side elevational view of the applicator illustrating a drive for the power feeding of a solid adhesive member (e.g., a rod as shown in phantom) into the heated head so as to force melted adhesive from the head onto the spine and so as to melt additional adhesive, with the head having an opening (e.g., a slot) in the end face thereof for the application of melted adhesive to the spine of the book block.

As indicated at 207, a milling station is provided along the work path WP for milling or roughening the spine of the book block as the book block is conveyed past the milling station. The roughening of the spine aids in adhesion of the adhesive to the spine. As disclosed in my above-noted pending U.S. patent application Ser. No. 12/576,923, the spine milling station may be replaced by a stationary blade spine roughener, as depicted in FIG. 6 of this last-noted pending application.

Next, an adhesive application station, as indicated at 209 (as described in detail below), is provided along the work path for applying hot melt adhesive to the spine S of the book block. The carriage C is further movable from the adhesive application station 209 to a binding station 211 at which the spine S of the book block while clamped by the clamp of the carriage C is brought into engagement with a predetermined portion of a book cover BC (e.g., the center portion of the cover) to be bound to the book block by the adhesive applied to the spine of the book block. Book cover BC is typically of a paper stock heavier than the pages of the book block, but those of ordinary skill in the art will recognize that the cover may be of suitable materials other than paper, such as a suitable plastic film or the like. This binding station includes a binding clamp 213 for clamping the book cover BC and the book block BB proximate the spine S of the book block so as to effect binding of the cover to the book block. Thence, the book block and the cover are moved by the carriage to a trimming station 215 at which excess margins of the bound book may be trimmed so that the finished bound book is of a predetermined finished size. The trimming station 215 is as described in my above-noted prior U.S. patents. The trimmer may also be of the type described in my U.S. Pat. No. 6,928,914, which is also herein incorporated by reference, or by the trimming station 61 described in my pending U.S. patent Ser. No. 12/576,923. However, it will be understood that none of the apparatus described in regard to FIG. 1 forms a required portion of the adhesive applicator or method herein described, but rather this only describes the application environment of the applicator and method herein disclosed.

As shown in FIG. 1, adhesive application station 209 includes a prior art heated glue pot or reservoir 217 in which a large quantity of hot melt adhesive (as compared to the applicator herein described) is maintained at an elevated temperature (e.g., about 350 F°±25° F. or some other desired temperature) so as to be in a liquid or molten state. A rotary drum 219 is partially submerged in the molten adhesive and is rotated as the carriage C approaches the adhesive application station and while the spine of the book block is in operative engagement with the drum so that the drum picks up a layer or coating of molten adhesive on its outer peripheral surface and applies it to the spine of the book block. The surface speed of the rotating drum and the speed of the book block are generally controlled to be substantially the same so as to facilitate the uniform application of molten adhesive to the book block spine. As noted, with the spine S of the book block BB disposed beneath carriage C, the spine engages the upper surface of drum 219 as the carriage is moved past the adhesive application station and thus picks up a layer of melted hot melt adhesive from the drum.

A book cover BC (see FIG. 1) is positioned at the binding station 211 with, for example, its inner center portion disposed to be in register with the spine S of the book block when the carriage moves into position at the binding station and stops. The spine of the book block with the adhesive thereon is moved into engagement with the book cover and a clamp (for example, such as described at reference character 35 in my U.S. Pat. No. 6,193,458, which is incorporated by reference herein, or as described in my pending U.S. patent Ser. No. 12/576,923) is actuated to tightly grip the cover and the book block proximate the spine of the book block for a time sufficient (e.g., a few seconds) to allow the adhesive to bind the cover to the book block.

It will be understood that the adhesive applicator of the present disclosure, as generally indicated at 1 in FIGS. 2-8, is intended to be a replacement for the adhesive application station 209, as above described. Applicator 1 of the present disclosure may be disposed below carriage C so that the applicator may apply adhesive to the spine S of the book block BB from below, or, as shown in FIGS. 2-10 the carriage C may be modified so that book block BB is oriented horizontally (or at any other desired orientation or position) instead of vertically so that the applicator 1 may apply a coating (layer) of hot melt adhesive or the like to the spine S, as shown in FIGS. 2-8.

Referring now to FIGS. 2-8, book block BB is shown to be oriented in a horizontal position with the spine S facing toward applicator 1. However, within the broader aspects of this disclosure, as would be readily apparent to one of ordinary skill in the art, the applicator 1 may also be a replacement for the adhesive applicator station 209 illustrated in FIG. 1 where the applicator is positioned below the spine S of a vertically disposed book block, or any other desired orientation of the book block and the applicator.

More specifically, applicator 1 comprises an applicator frame 3 mounted for movement relative to the spine S of book block BB on a pair of spaced tracks or rails 5 so as to be movable relative to the book block along the full length of the book block. As shown in FIGS. 2-8, book block BB and rails 5 are shown to be horizontal, but those skilled in the art will appreciate that the book block and the rails may be disposed in any other desired position. While the applicator 1 is shown to be movable relative to a stationary book block BB for the applicator to apply adhesive to the spine, it will be understood that within the broader aspects of this disclosure that applicator 1 may be held in a stationary position and that the book block may be moved relative to the applicator 1 so as to apply adhesive to the spine.

Figure 8:
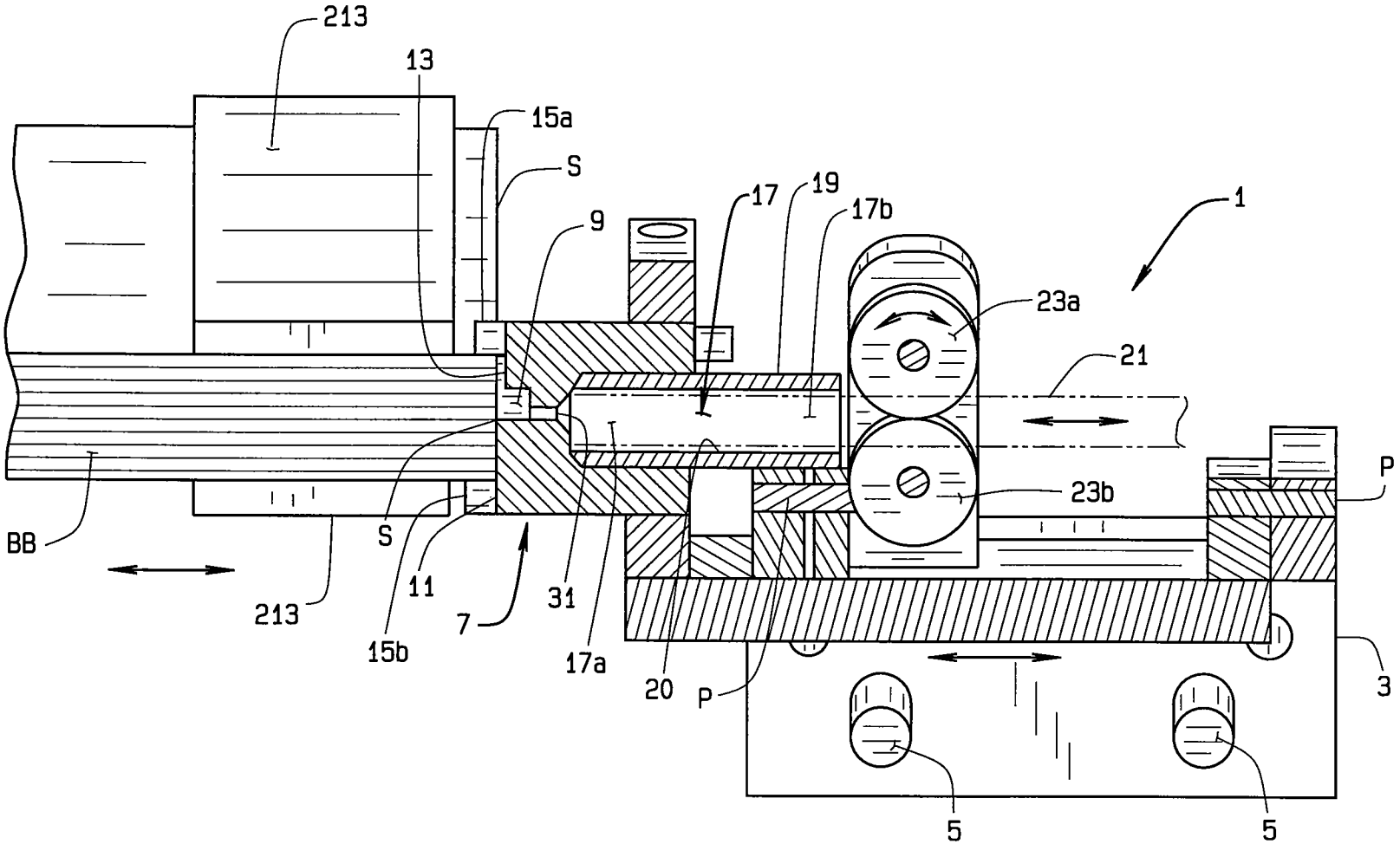
FIG. 8 is a partial cross sectional view of the applicator shown in FIG. 7 having a chamber within the head in which a small quantity of hot melt adhesive is melted, an orifice between the chamber and the slot so that upon the melted adhesive being forcibly dispensed through the orifice and into the slot, the melted adhesive is dispensed for application onto the spine.

As shown in FIGS. 2-8, applicator 1 has a head 7 facing toward the spine S of the book block BB. As best shown in FIG. 8, head 7 has an opening (preferably, but not necessarily a slot) 9. The head 7 is preferably cylindrical and opening or slot 9 preferably extends out of the head and diametrically across the end face of the head with the slot facing toward the spine S of the book block. Head 7 has one portion of the head 11 on one side of slot 9 (i.e., on the side of the head toward the direction of relative movement between the head and the book block as the adhesive is applied to the spine) with this one head portion being referred to as the "leading" head portion. This leading head portion 11 extends out beyond the other portion 13 of the head on the other side of the slot with this other portion being referred to the "trailing" head portion. It will be understood that in order to apply adhesive to the spine of the book block, the leading portion 11 is in operative relation (either in contact with or spaced a slight distance from) the spine of the book block as the adhesive is applied. The distance that the trailing head portion 13 is stepped back from the leading head portion 11 thus regulates the thickness of the coating of adhesive applied to the spine. As noted, opening 9 is preferably a slot that extends diametrically across the end face of head 7. However, in place of such a slot, it will be understood that this adhesive dispensing orifice may be one or more openings in the head and a wiper bar (not shown) may be provided for coating the adhesive onto the spine S across the full width or thickness of the spine as the applicator moves relative to the spine.

Head 7 is preferably made of a good heat conductor metal, such as aluminum, copper, or the like, and has one or more heaters in heat conduction relation with the head for heating of a quantity of hot melt adhesive therein to an elevated temperature sufficient to melt the adhesive for application to the spine of the book. Specifically, head 7 is shown in the drawings (see FIG. 7) to have a pair of electric rod heaters 15*a*, 15*b* in heat conduction relation with the head with one of the heaters in heat conduction relation with head portion 11 and with the other heater in heat conduction relation with head portion 13. Such heaters may be electric rod heaters commercially available from McMaster Catalog, item number 3614K35. While the wattage and size of such heaters may vary depending on the size of head 7 and other factors, it has been found that heaters of a wattage of about 100 watts have worked well with the adhesive herein described. Of course, a suitable source of electrical power (not shown) for these heaters must be provided.

As further shown in FIG. 8, head 7 has an adhesive melting chamber 17 therein and a sleeve 19 with a sleeve bore 20 for receiving an elongate rod-like member 21 of solid adhesive. Preferably, but not necessarily, the adhesive is a so-called "hot melt" adhesive. The term "hot melt adhesive" as used herein will be understood in a broad context to mean any adhesive which is normally in a solid state at room temperature, which is normally heated above room temperature for application to one or more articles, and which rapidly sets so as to bond two articles together. The terms "melt" or "molten", as used in this disclosure regarding the adhesive, will be understood to mean to heat the adhesive to a temperature so as to be flowable. It will be understood that most hot melt adhesive manufacturers recommend that the adhesive be heated to a within a preferred temperature range so as to best result in application and setting (bonding) of the adhesive to the articles (substrates) to be adhesively bonded together. However, within the context of this disclosure, it may not be necessary to heat the adhesive to the temperature recommended by the adhesive manufacturer, but rather to some other temperature that may work for this application.

One example of a suitable hot melt adhesive usable in applicator 1 is adhesive HM8101PE, commercially available from Capitol Adhesives, of Mooresville, Ind. It is typically available in chip form, but it can be ordered or formed into an elongate rod and rolled into a coil and unrolled as needed. It will also be appreciated that the adhesive member 21 is a solid at room temperature and is of a sufficient length to bind a relatively large number of books, depending on the length of the rod-like member or the length of the coil.

As noted, the adhesive member 21 is of a hot melt adhesive which is a solid at normal room temperatures and which must be melted to form a semi-liquid or a molten adhesive at an elevated temperature so as to be applied to the spine S of the book block BB. While the temperature required to melt such a hot melt adhesive may vary considerably, it has been found that if the hot melt adhesive, as described above, is heated to a temperature of about 350 F°, plus or minus 25° F., the adhesive will be sufficiently melted to be applied to the spine S of the book block BB and it will remain at a sufficiently high temperature when the spine of the book block is brought into binding engagement with book cover BC at the binding station 211 of the apparatus shown in FIG. 1, or in a similar apparatus. Also, it has been found that if such adhesive is heated to such an elevated temperature, the melted adhesive will wet the edges of the book block pages along the spine so that the adhesive will satisfactorily bind the book block to the cover upon binding.

As will be appreciated, the heaters 15*a*, 15*b* heat the head 7 to a temperature so as to melt the hot melt adhesive within the chamber 17. As noted above, typical hot melt adhesives used with this disclosure are heated appreciably above room temperature, for example to about 350 degrees F.,±25 degrees F. Of course, head 7 is also heated to such elevated temperatures. It will be appreciated that as head 7 is moved into position to apply the adhesive to the spine S of the book block BB, the outer face of the head (at least the face of head portion 11) is in heat conduction contact with the spine. It has been found that the heated head portion at least in part heats the outer surface of the spine to an elevated temperature prior to the application of the adhesive thereto, which results in better wetting of the adhesive to the pages of the book block along the spine and results in better binding of the cover to the book block. By the term "wetting", it will be understood that the application of the molten adhesive from slot 9 is in better adhesive contact with the book block resulting in a more secure bonding of the book block to the spine and of the pages constituting the book block along the spine.

As shown in FIG. 8, the elongate adhesive member 21 is positively fed into chamber 17 by a pair of wheels 23*a*, 23*b*. These wheels are biased (e.g., spring loaded) toward a nip position (as shown in FIG. 8) so as to grip the adhesive member 21 therebetween. It will be appreciated that one or both of the spring loaded wheels may be moved apart from their nip position so that an adhesive member 21 may be inserted between the wheels such that upon release of the spring biased wheels, the wheels will frictionally grip the rod-like member therebetween and allow the adhesive member to be positively advanced into chamber 17 upon at least one of the wheels being driven in one direction or to be positively withdrawn from the chamber if the driven wheel is rotated in the opposite direction. At least one of the wheels 23*a*, 23*b* is power driven by a drive motor 25, as shown in FIG. 2. While many different drives may be employed to positively feed the adhesive member 21 into the melt chamber 17, drive motor 25 is shown in FIG. 2 to be a reversible stepper motor under the control of the computer controlled described in the above-noted U.S. patents (or as described in my pending U.S. patent Ser. No. 12/576,923) that are incorporated by reference for purposes as will appear. Motor 25 has a rotary driven output shaft 27, preferably in the form of a worm in engagement with a driven worm gear 29. It will be appreciated that drive wheels 23*a*, 23*b* and drive motor 25 thus serve as an actuator for dispensing molten adhesive onto spine S.

As noted, motor 25 is preferably a reversible stepper motor under the computer control of a computer controller, such as is disclosed in my above-noted U.S. patents. In this manner as a particular book is printed by the apparatus as described in my above-noted U.S. patents or as described in my pending U.S. patent application Ser. No. 12/576,923, the thickness of the book block BB to be printed and bound is "known" to the computer controller and the controller will "know" approximately how much adhesive must be applied by applicator 1 so as to apply a coating of adhesive of a desired thickness to the spine S of the book block BB. For example, the amount of adhesive to be applied to the book block spine S may be computed by multiplying the thickness of the book block spine x the length of the spine x the thickness of the adhesive to be applied. In this manner, the controller will energize motor 25 so as to advance a predetermined length of the adhesive member 21 into chamber 17 so to forcibly dispense a sufficient amount of melted adhesive from chamber 17 so as to apply a uniform adhesive coating to the spine of the book block as the applicator 1 is moved relative to the spine of the book block. In this manner, a uniform coating of hot melt adhesive is applied to the full width and length of the spine of the book block at the binding station 211.

As further shown in FIG. 8, chamber 17 has a heated portion 17*a* heated by heaters 15*a*, 15*b*, and an unheated portion 17*b*. The heated portion 17*a* contains a small quantity of melted adhesive therein so that upon the applicator initially applying hot melt adhesive to the spine S, a sufficient quantity of melted adhesive is available to apply to the spine of a first book block BB (or to a small number of book blocks) without the need to heat a large quantity of the adhesive to its desired application temperature. As herein described, the quantity of adhesive in chamber 17*a* may be at room temperature or at an elevated holding temperature considerably below its desired application temperature and then heated to its desired application temperature in a relatively short time, as compared to the time required to heat the adhesive in the glue pot of the glue pot 217 in the apparatus 201 shown in FIG. 1. The length of time to heat this small quantity of adhesive to its desired application temperature is generally less than the time for a print on demand book publication system to print the book block so that the adhesive is ready to be applied when the book block is presented to the adhesive application station.

As indicated at 31, a dispensing orifice is provided in head 7 between melt chamber 17*a* and slot 9. In order to selectively force or dispense the heated (melted) adhesive from chamber 17*a* and onto spine S, motor 25 is energized to drive the driven wheel 23*a* so as to advance adhesive member 21 into the heated chamber 17*a*. It will be appreciated that the adhesive member has a relatively close, sliding fit within the walls of chamber 17 so that as the adhesive member is advanced into the chamber, the walls of chamber 17 slidably, sealingly engage the adhesive member such that the advancing adhesive member acts as a piston so as to move additional adhesive into the heated chamber 17*a* and to force a quantity of the heated (melted) adhesive out of the chamber 17*a* via orifice 31. In this manner, the movement of the adhesive member into the chamber 17 acts as a positive displacement pump which forces the flowable adhesive from the chamber and dispenses the adhesive onto the spine of the book block. The chamber 17*a* is preferably of sufficient volume so as to contain a sufficient amount of melted adhesive to coat the spine of the thickest book block and the spine of the book block of the longest length within the above-noted range of book block thicknesses and lengths to be bound by the apparatus of the present disclosure without having to await for additional adhesive to be melted. As the adhesive member is advanced into chamber 17*a*, the heated walls defining the chamber will melt the rod-like member so as to insure that an adequate supply of melted adhesive is available in the chamber to be applied to the spine S of the next book to be bound. Preferably, but not necessarily, the heaters 15*a*, 15*b* will heat the portion of the adhesive member 21 within the heated chamber 17*a* to a temperature sufficient to bind the next book block and cover in a short period of time generally commensurate with the time for the next book block to be transported to the adhesive application station 209, as shown in FIG. 1.

Further, as the applicator 1 is moved on rails 5 along the length of the book block BB, the computer controller described in the above-identified U.S. patents which have been incorporated by reference "knows" the thickness and length of the spine of the book block to be bound such that as the applicator moves toward end of the spine, the computer controller may signal motor 25 to at least partially withdraw the rod-like adhesive member 21 from chamber 17 a short distance. This withdrawal of the adhesive member 21 from chamber 17*a* not only terminates the flow of liquid adhesive from slot 9, but it will also draw a small quantity of the molten adhesive within the slot 9 back into chamber 17*a*. This has the effect of preventing dribbling or leakage of the hot melt adhesive onto the sides and ends of the book block, which has been problematic with prior glue pots (as illustrated in FIG. 1) because such excess adhesive may soil the book being bound and because such excess adhesive may build up on the binding apparatus thus requiring periodic clean up of the apparatus. It will be appreciated, however, that a small quantity of adhesive may flow onto the outer sheets of the book block proximate the spine so as to aid in binding the cover to the book block.

It will also be appreciated that because only a relatively small amount of adhesive is resident in heated chamber 17*a*, upon startup of the adhesive applicator 1 when the heaters are initially energized, only the small quantity of adhesive in chamber 17*a* need be heated to a desired operating temperature. This small quantity of adhesive may be heated to its application temperature in a relatively short time, as compared to the time it took to heat the glue pot of the prior art adhesive application station 209, as illustrated in FIG. 1. The time required to sufficiently heat head 7 and the adhesive in chamber 17*a* to a temperature sufficient for application to the spine S is less than the time it would require for the apparatus disclosed in my prior U.S. Pat. No. 7,014,182 to print a first book block BB. Thus, if the head and the adhesive in chamber 17*a* were at room temperature (or at a holding temperature above room temperature but well below the temperature at which the adhesive gives off offensive odors or degrades when held at such temperatures for extended periods), when the printing of a first book block of a print on demand book is commenced, as disclosed in my U.S. Pat. No. 7,014,182 or in my pending U.S. patent Ser. No. 12/576,923, the head and the adhesive in chamber 17*a* will be heated to a temperature sufficient to apply the adhesive to the spine and to bind the book block to its cover while the book block for that book was being printed. It will be further appreciated that if faster melting of the adhesive within chamber 17*a* is desired, additional heaters or heaters of increased power (wattage) may be provided in head 7.

It will be further appreciated that if the adhesive applicator 1 is not used for a short period of time (e.g., 15 minutes or so), the heaters 15*a*, 15*b* may be powered down by the aforementioned computer controller so as to allow the head and the adhesive in chamber 17*a* to cool to room temperature or to a temperature significantly less that the above-stated application temperature. Upon the computer controller sensing that a book block is to be printed, the computer controller energizes the heaters 15*a*, 15*b* so as heat the adhesive in chamber 17*a* to its desired application temperature such that the hot melt adhesive would be ready for application by the time the book block is ready to have adhesive applied thereto. Because it is not necessary to hold a large quantity of the adhesive at its application temperature for extended periods of time, the adhesive will not degrade (as above described in the Background). Also, because the quantity of adhesive required to be heated at any one time to apply a coating to the spine of a book block is a relatively small quantity, as compared to the volume of hot melt adhesive required to be maintained in the glue pot of prior art adhesive applicators, the quality of the adhesive will fully meet the specifications of the adhesive manufacturer and the more volatile components of the adhesive will remain and will not be given off to the ambient atmosphere. Of course, holding the adhesive at such lower temperatures when not actually binding books greatly lessens the unpleasant fumes or odors that are typically given off by hot melt adhesives when held at elevated temperatures for extended periods and thus make the print on demand book printing, binding and trimming apparatus, as described in my above-noted patents more acceptable in offices, retail stores, and other applications including "warehouse" or "factory" book printing operations. It will also be appreciated that by powering down the heaters when the print on demand book making apparatus is not in use will also save considerable energy.

In accordance with this disclosure, with a book block BB in position to have adhesive applied to its spine S by the applicator 1, the book block is moved relative to head 7 such that the leading portion 11 of the head is in operative relation with the spine. This can be accomplished by a stepper motor (not shown) that moves the head 7 axially toward and away from spine S. However, it may be preferred to move the book block BB toward and away from the head 7.

Figure 11B:
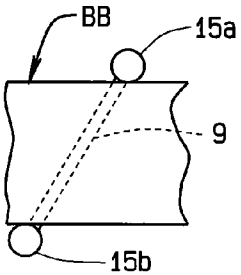
FIG. 11B is a view similar to FIG. 11A showing the head in a rotated position with the ends of the stops in engagement with the top and bottom faces of the book block proximate the spine such that the slot extends diagonally across the spine such that upon dispensing of the molten adhesive from the slot adhesive is applied to substantially the full width of the spine.
Figure 11A:
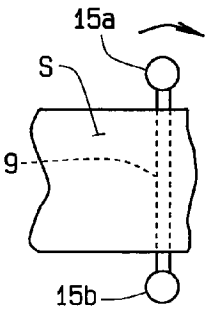
FIG. 11A is a diagrammatic view of a portion of the spine of a book block having a thickness less than the spacing of the stops (e.g., the ends of the heaters) on the head with the slot in the head depicted in dotted lines extending generally between the stops and further showing the orientation of the head in its initial position with the slot extending generally perpendicular across the spine of the book block so as to prevent further rotation of the head relative to the book block.

As noted above, in the embodiment shown in FIGS. 2-9, with the applicator 1 in its operative position, the applicator is moved relative to spine S so as to apply the adhesive. Also as previously described and as illustrated in FIGS. 11A and 11B, head 7 is at least partially rotated from an initial position in which slot 9 is in a generally vertical position (i.e., in a position generally perpendicular to the spine S of the book block, as shown in FIG. 11A) to an inclined or angled position (as shown in FIG. 11B) in which the slot angles diagonally across the spine. Typically, when head 7 is rotated from its initial to its inclined position, the end faces of head 7 is in operative engagement with spine S. In this manner, the slot will apply adhesive to the full thickness of the spine of a book block of the maximum thickness within a limited range of thicknesses having a maximum thickness and a minimum thickness. While the above-described initial position of the slot 9 is described to be generally perpendicular to the spine S, those skilled in the art will recognize that it may be inclined somewhat from the vertical or perpendicular position.

Figure 3:
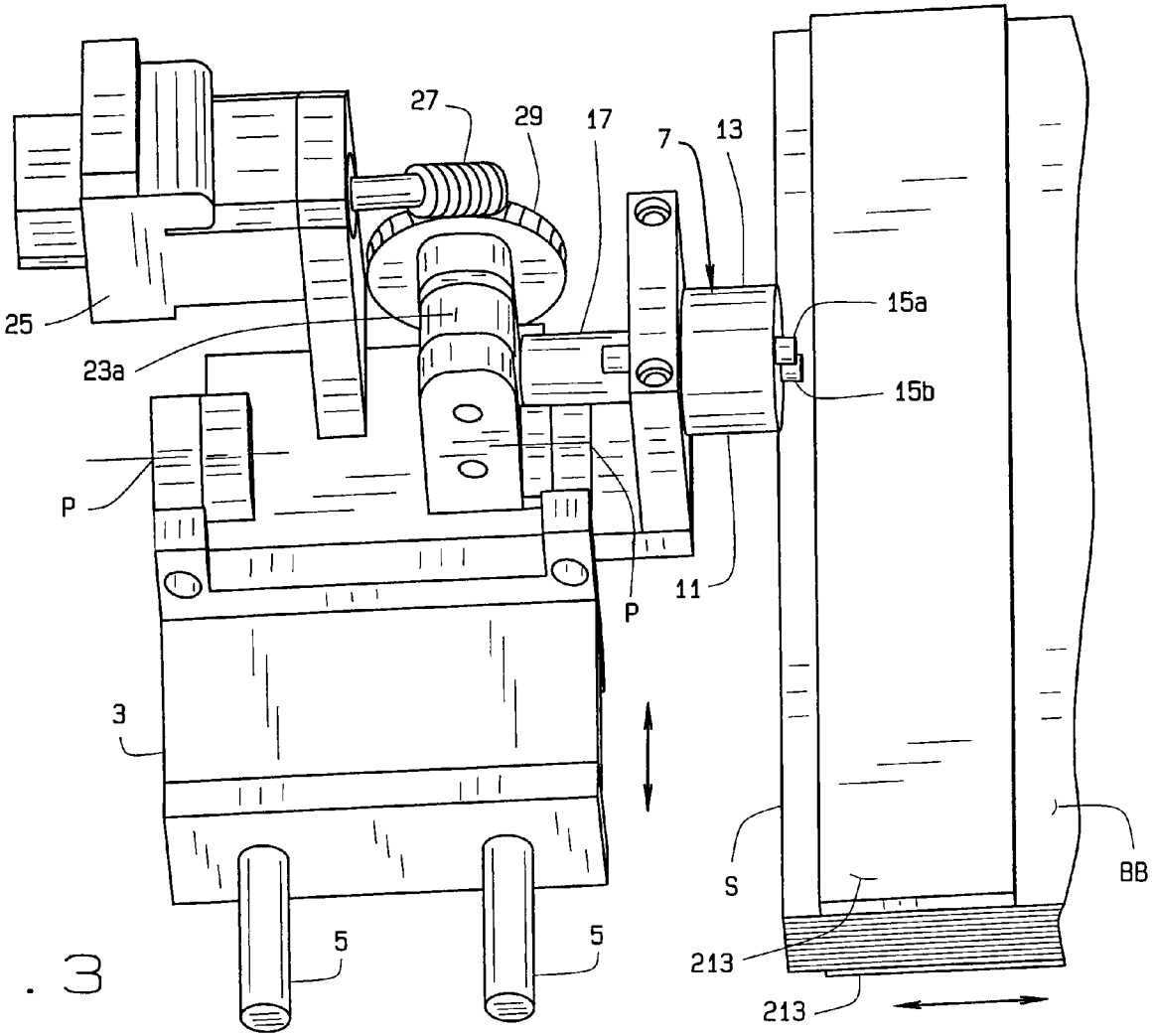
FIG. 3 is another perspective view of the applicator with so-called gage pins positioned above the spine of the book block.
Figure 4:
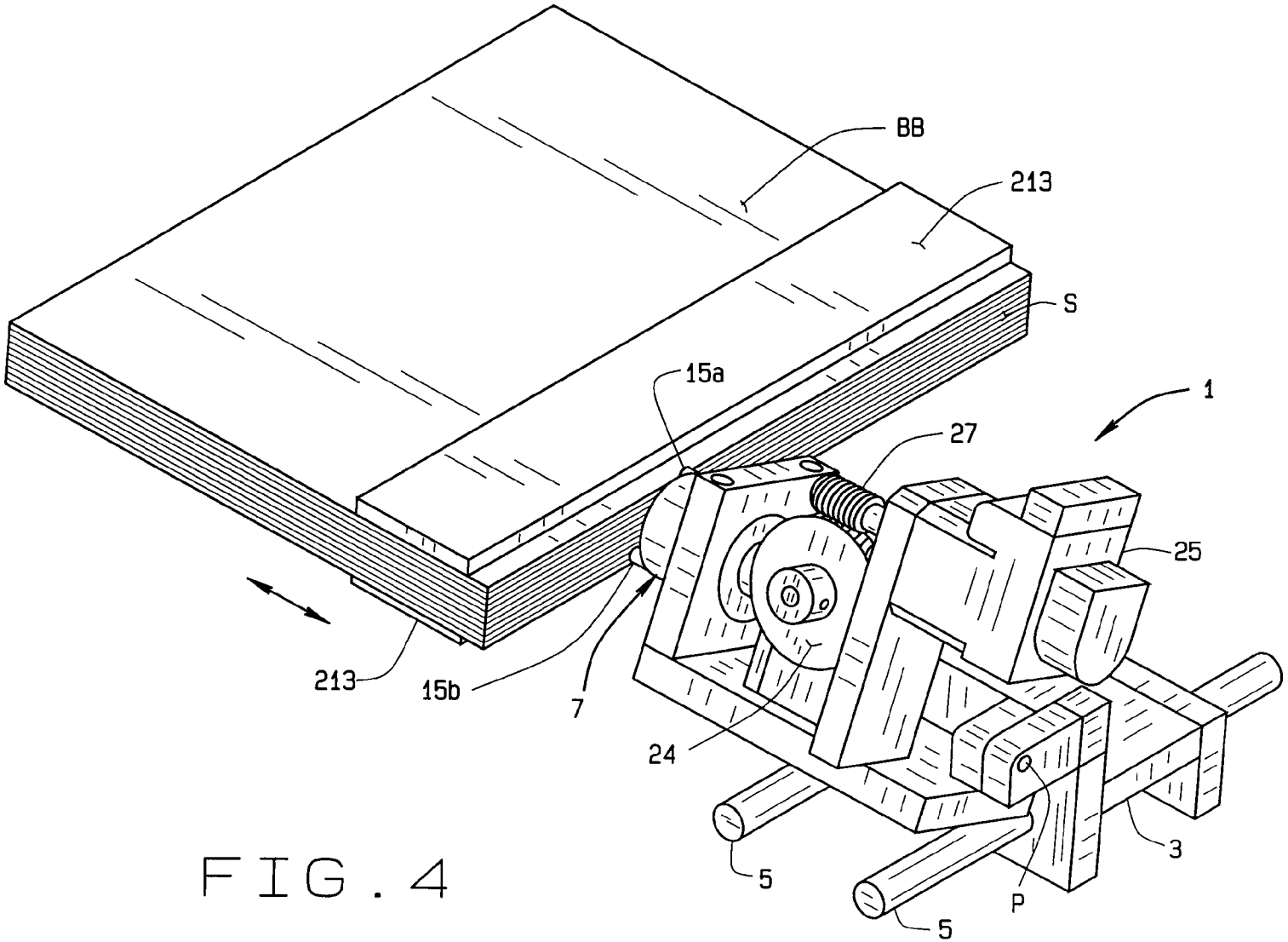
FIG. 4 is still another perspective view of the applicator with an applicator head in its retracted position clear of the spine of the book block.
Figure 5:
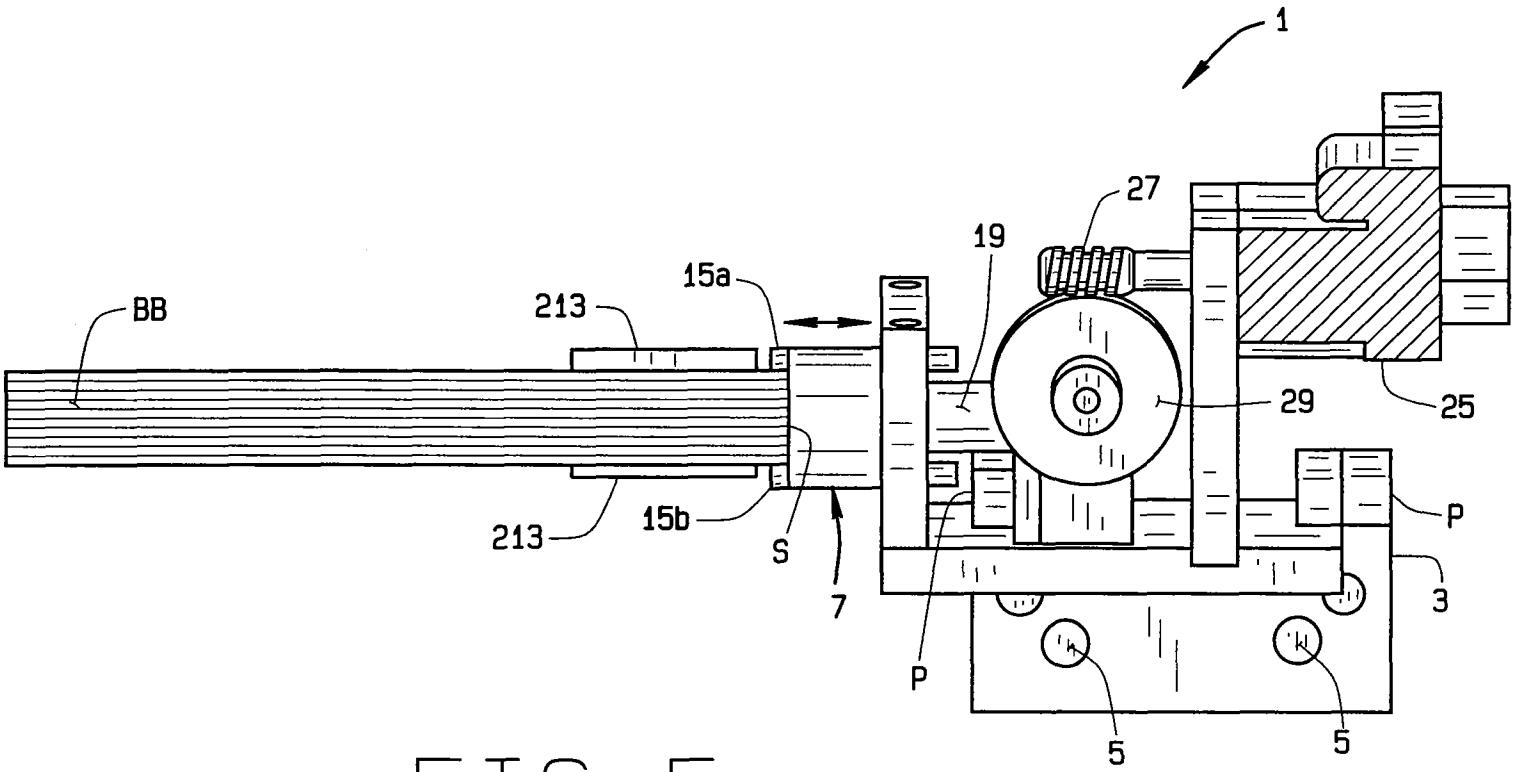
FIG. 5 is a side elevational view of the applicator illustrating that an applicator head of the applicator and the spine of the book block are moveable toward and away from one another between an operative position (as shown in FIG. 5) in which the end face of the applicator is in operative engagement with the spine of the book block so that adhesive may be applied to the spine of the book block and in which stops or gage pins extending out from the end face of the head are engageable with the top and bottom faces of the book block proximate the spine, and a retracted position (not shown) in which the end face of the applicator head is clear of the spine.

Both of these movements (i.e., rotation of the head and movement of the head along the length of the spine of the book block) may be accomplished by wrapping a cable, as indicated at 33 as shown in FIG. 2, around the outside of head 7, by rotatably mounting head 7 with respect to frame 3 so as to rotate about pins P (the centerlines of which are shown in FIG. 3), and by pulling on the cable by means as, for example, by a stepper motor (not shown) under control of the computer controller. After the head has been rotated and after a pair of spaced stops (which may be the outer ends of heaters 15*a*, 15*b* or separate stop members or gage pins) engage the upper and lower faces of the book block proximate spine S and thus stops further rotation of the head, as the stepper motor further draws the cable 33 to the right (as shown in FIG. 2), the frame 3 will be drawn to the right along rails 5. It will be appreciated that the rotatable mounting of head 7 with respect to frame 3 is such that the head is spring biased to return to its initial position when the tension of cable 33 is relaxed. Initially, when the head is in its relaxed, the slot 9 is in its generally vertical position extending across spine S. A second stepper motor (not shown) may draw cable 33 in the opposite direction to return the frame 3 along rails 5. However, the applicator 1 may be spring biased to return to its initial position in which the applicator head 7 is positioned to engage the leading end of spine S when the head is moved into position so as to apply the adhesive to the spine. It will be understood by those skilled in the art that other means for moving applicator 1 along rails 5, other than cable 33, may be used. For example, the frame or carriage 3 may be connected to a drive screw (not shown) which in turn is driven by a suitable motor (e.g., a stepper motor) under the control of the computer control system for moving the applicator along the rails so as to apply the adhesive to the spine S of the book block BB.

As shown in the drawing figures, the ends of heaters 15*a*, 15*b* preferably extend out beyond the end face of head 7 and thus serve as the above-mentioned stops such that one of the heaters (e.g., the uppermost heater 15*a*) overlies the upper surface of book block BB when the head 7 is in its initial position with the slot and the other heater 15*b* underlies the book block when the head is extended so as to operatively engage the spine Thus, with the head in operative engagement with spine S and with the slot in its initial position (e.g., in an initially generally vertical position in which the slot is generally perpendicular to the spine S), upon the stepper motor (not shown) pulling on cable 33 causing head 7 to rotate (as above described), the head will rotate relative to spine S and the end of the upper heater or stop 15*a* engages the upper face of the book block adjacent spine S and the outer end of the lowermost heater or stop 15*b* engages the lower surface of the book block adjacent the spine such that the slot 9 in head 7 will assume an inclined position. This rotational movement of the stops 15*a*, 15*b* from their initial or vertical position to their inclined position with the slot extending diagonally across the spine S is illustrated in FIG. 11B.

It will be appreciated that with the outer ends of the heaters 15*a*, 15*b* in engagement with the book block on opposite faces of the book block proximate the spine S, further rotation of the head is prevented as the cable 33 is pulled taut to the right, as shown in FIG. 2. Thus, the outer ends of the heaters serve as gage pins or stops to limit rotation of the head in relation to the thickness of the book block to be bound. In this manner, the full length of slot 9 engages the spine S, regardless of the thickness of the book block BB. Also, excess adhesive dispensed from the end portions of the slot is effectively prevented from spilling over onto the edges of the book block proximate the spine. Upon further tensioning of the cable 33 by its drive (e.g., a stepper motor under computer control), the applicator 1 is caused to move relative to the book block on its rails 5 along the full length of the spine S of the book block at a predetermined rate. In this manner, it is insured that the slot 9 extends fully across the full thickness of the spine and so as to allow the head to apply a uniform layer of adhesive to the full width and length of the spine as long as the thickness of the book block is within a range between a maximum and a minimum thickness. Further, the rate at which the applicator 1 is moved along its rails 5 is under computer control so as to insure that a sufficient amount of melted adhesive in heated chamber 17*a* is forced out of slot S by advancement of the adhesive member 21 into the heated chamber by drive wheels 23*a*, 23*b*. This insures that a desired amount of adhesive is applied to full width and length of the spine at a desired temperature level so that upon joining the spine of the book block to the center portion of its cover at the binding station 211, the cover will be properly bound to the book block. As noted, there is no upper limit (within practical limits) as to the maximum thickness of the book block that may be coated with adhesive by the applicator 1, but as a practical matter book blocks having more than about 1000-1200 pages (500 to 600 sheets of paper) tend to be the upper limit of the thickness of book blocks that are perfect bound. Likewise, book blocks having fewer than about 25 sheets are somewhat difficult to perfect bind. Further, while there is no predetermined maximum or minimum length of the spine S of book blocks to which the apparatus disclosed herein may be used to apply adhesive, it will be understood that the range of the lengths of such spines is generally commensurate with the sizes of conventional perfect bound books, however, within the extent of this disclosure, the length of the book block may be any desired length.

Figure 9:
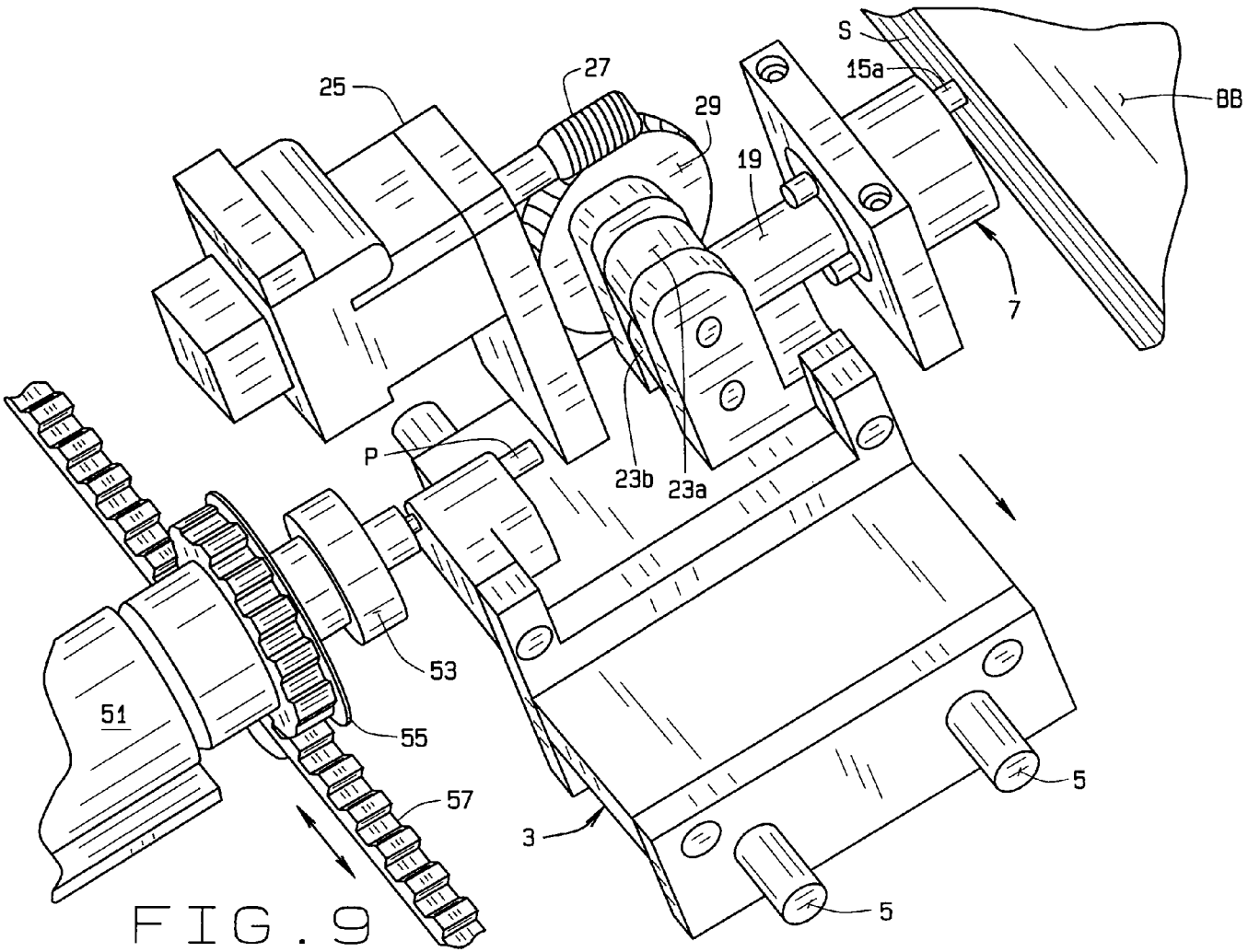
FIG. 9 is a perspective view of an alternative embodiment of the applicator of this disclosure in which the applicator head is rotated about a pivot axis generally perpendicular to the spine of the book block by a motor and a slip clutch from a position in which slot extends generally perpendicular across the full width of the spine to a diagonal position in which the slot is angled across the width of the spine and in which stops at the ends of the slot are in engagement with opposite faces of the book block adjacent the spine such that continued operation of the motor caused the clutch to slip and caused the motor, via a rack and pinion arrangement (e.g., a gear mounted to the motor and a linear rack), to drive the frame and the head along support rails such that the adhesive dispensed from the slot is uniformly applied to the spine along the full length of the spine.
Figure 10:
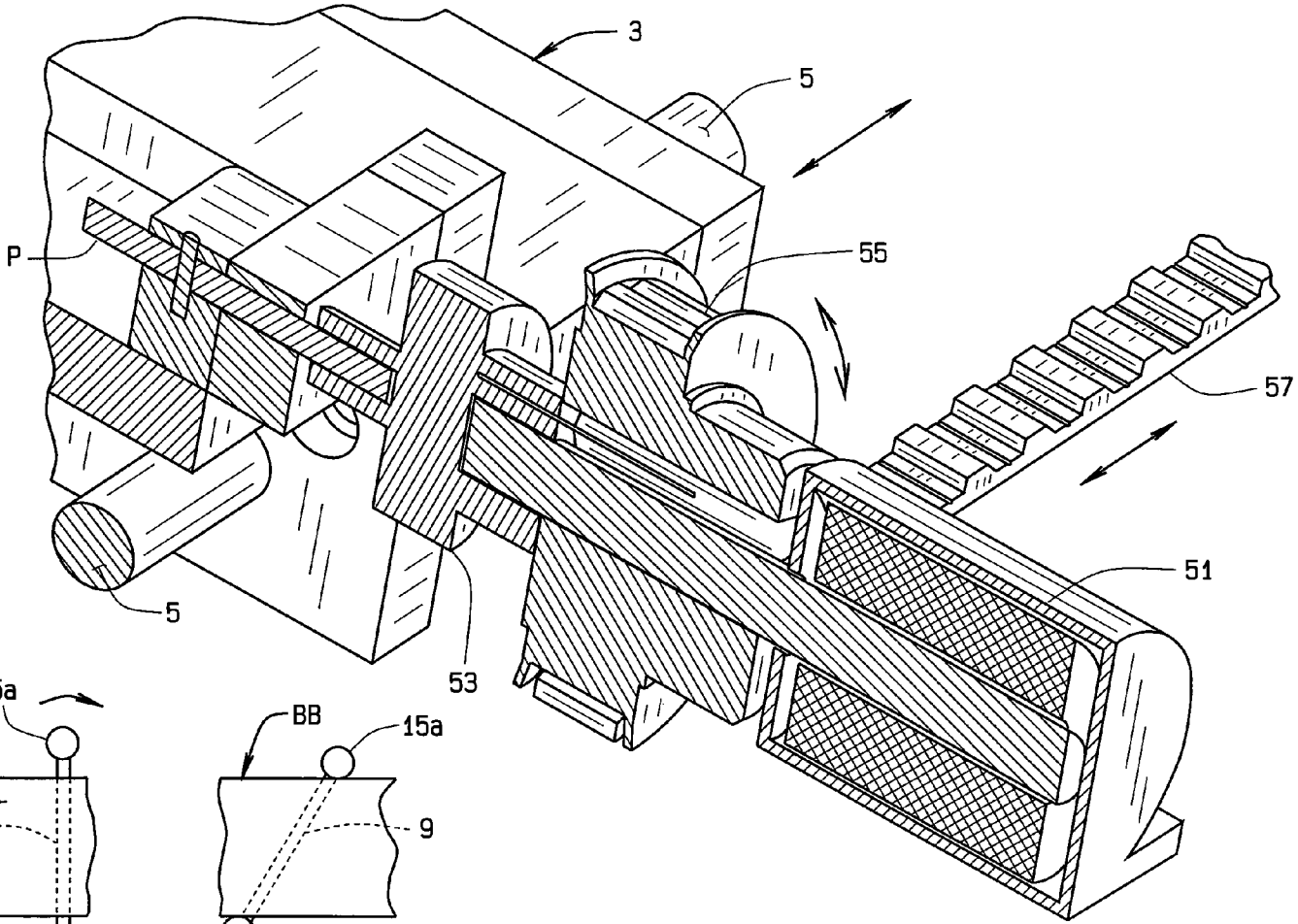
FIG. 10 is an enlarged partial section view of the embodiment of FIG. 9 illustrating the motor, a sprocket or pinion in engagement with the rack, and the slip shown in FIG. 9.

As shown in FIGS. 9 and 10, an alternate system is shown for rotating head 7 relative to frame 5 and relative to spine S of the book block BB about the axis of pins P so that the slot 9 is properly oriented with respect to spine S. As shown in FIG. 9, a motor 51 is connected to the axis of pins P by way of a slip clutch 53. A sprocket or pinion 55 is carried on the output shaft of motor 51 with the sprocket in engagement with a rack 57. As shown, rack 57 may be a toothed timing belt. With the end face of head 7 in operative engagement with spine S of book block BB, upon initial operation of motor 51 to rotate the output shaft of clutch 53 in counterclockwise direction (as shown in FIG. 9), head 7 will also rotate about the axis of pins P in counterclockwise direction. With the outer end of heater (stop) 15*a* positioned above the upper face of the book block (as shown in FIG. 9), and with the outer end of the other stop 15*b* positioned below the lower face of the book block, and with the slot 9 in the head positioned to be generally perpendicular to the thickness of the spine, this counterclockwise rotation of head 7 will cause the outer ends of heaters (stops) 15*a*, 15*b* to respectively move into engagement with the upper and lower faces of the book block thus preventing additional rotation of the head. In such position, the end face of the head is in an operative position with respect to the spine S so that the slot 9 in the head extends diagonally across the spine. After the head 7 has been so rotated such that the ends of the heaters 15*a*, 15*b* engage the upper and lower faces of the book block, clutch 53 will slip and continued operation of motor 51 will cause the sprocket 55 to rotate. Of course the sprocket is in mesh with the toothed belt or rack 57 and the continued operation of the motor moves the frame 3 along rails 5 to the right, as shown in FIG. 9, so that the head will be moved along the length of spine S to apply adhesive to the full length of the spine. As the head reaches the end of the spine, energization of motor 51 is terminated and the book block is moved clear of the head (or the head is moved clear of the book block spine). Then, motor 51 is operated in the opposite direction so that sprocket 55 in engagement with rack 57 moves the frame 3 and applicator 1 in the opposite direction along rails 5.

It will be appreciated that with the outer ends of the heaters 15*a*, 15*b* in close proximity to the outer ends of slot 9, the ends of the heater effectively block most of the flow of adhesive from the slot so that excess adhesive does not flow onto the front and back faces of the book block adjacent the spine S. However, it will be understood that it may be desirable that some of the adhesive from the slot may flow onto the front and back faces of the book block (but not an excessive amount) proximate the spine so as to aid in adhering the inner face of the cover to the book block, especially near the spine.

It will be appreciated that because the adhesive within chamber 17 need only be heated for a short time in order to heat it to its desired application temperature (e.g., about 350° F.), the heating process of the adhesive may be started when such print on demand book publishing system as disclosed in my U.S. Pat. No. 7,014,182 is commanded to print a book. Thus, because it only takes a few minutes to print the book, the heated adhesive within the chamber does not substantially degrade and has its desired adhesive properties when applied to the spine of the book block. Also, because the quantity of the adhesive heated in the chamber is small (typically only a sufficient amount to bind the cover to the book block, plus some extra), the odors and vapors given off by the heated adhesive are drastically reduced, as compared to the adhesive reservoirs, such as described in my prior U.S. Pat. No. 7.104, 182. Further, because the adhesive within chamber 17 may be heated to its desired application temperature within a matter of a few minutes while a book block is being printed, the adhesive is heated on demand thus eliminating the long adhesive melting times required with such prior print on demand book publishing systems.

In general, the term "print on demand" book, as used in this disclosure, will be understood to have a broad meaning in that one or more books may be printed and bound in response to an order or as they are ordered or demanded. The books need not be printed immediately in response to being ordered and they need not be ordered by a customer, where the term "customer" has its ordinary meaning of any person or entity that may purchase a book. Such books may be automatically ordered in anticipation of a demand to be filled, as by a computer inventory system or the like. Moreover, the orders for such books may be batched so that books of a particular size, books for specified customers, or books for a particular customer or shipping zone may be printed at one time. It will also be understood that orders for print on demand books may be for a single book or short runs (e.g., up to a few hundred books) may be ordered to be printed. It will be recognized that the apparatus and method herein described is not limited for use with print on demand book binding systems, but rather the apparatus and method described herein may be used in any perfect binding system, whether or not it is used to bind print on demand books or conventionally printed books.

As various changes could be made in the above constructions without departing from the scope of the disclosure, it is intended that all matter contained in the above description or shown in the accompanying drawings shall be interpreted as illustrative and not in a limiting sense.

The invention claimed is:

1. Apparatus for applying adhesive to the spine of a book block so that said book block to have a cover adhesively bound thereto along said spine, said apparatus comprising a head, said book block and said head being movable relative to one another toward and away from one another between an adhesive applying position in which said head is in operative relation with said spine so as to apply said adhesive to said spine and a retracted position in which said head is clear of said spine and further being movable relative to one another along a path substantially parallel to said spine of said book block, said adhesive being a solid member when at room temperature, said head having at least one heater for heating said adhesive to a flowable state for application to said spine, a drive which feeds said solid adhesive member into said head so as to be heated to said flowable state within said head, and a pump for effecting the dispensing of flowable adhesive from said head thereby to apply said adhesive to said spine as said book block and said head are moved relative to one another along said path, wherein said head having an end face adapted for the application of said flowable adhesive to said spine when said book block spine and said head are in operative relation with one another and when said book block and said head are moved along said path, said head having a slot across said end face with one portion of said head on one side of said slot extending axially out beyond another portion of said end face on the opposite side of said slot, said one portion of said head end face leads said slot relative to said relative to the direction of relative movement between said spine and said head during application of adhesive so that said other portion of said head is stepped back from said spine, and wherein said slot is in communication with said flowable adhesive within said head such that upon dispensing of said flowable adhesive said step back of said other portion of said head determines the thickness of said adhesive applied to said spine, wherein said book blocks range between a minimum and a maximum thickness, wherein the length of said slot is such that said slot extends across substantially the thickness of a spine of said maximum thickness book block, and wherein said head is rotatable about a horizontal axis from a first position in which said slot is generally perpendicular to said spine to an angled position so as to accommodate book block thicknesses ranging between said maximum thickness and a minimum thickness.

2. Apparatus as set forth in claim 1 wherein said head is spring biased to return to its said first position upon release from its angled position.

3. Apparatus as set forth in claim 1 whereupon said spine having said adhesive applied thereto, said adhesive member is partially withdrawn from said head so as to terminate the flow of said flowable adhesive.

4. Apparatus as set forth in claim 1 wherein said adhesive member constitutes said pump such that as said adhesive member is fed into a chamber so as to dispense said adhesive from said head.

5. Apparatus for applying adhesive to the spine of a book block for adhesively binding a cover to said book block where the thickness of said book block may vary within a limited range from a maximum thickness to a minimum thickness, and where said book block has a spine, said apparatus comprising:

(a) a head having a chamber therein for containing a supply of adhesive sufficient to bind at least one of said book blocks to a cover, said head having an end face adapted to be in operative relation with said spine of a book block so as to apply said adhesive thereto;

(b) a heater for heating adhesive within said chamber to a temperature sufficient to effect application of said adhesive to the spine of said book block;

(c) an opening in said end face of said head with one portion of said head on one side of said opening extending axially out beyond another portion of said head on the opposite side of said opening for the application of said adhesive to the spine of said book block;

(d) said one portion of said head leads said opening with respect to the direction of relative movement between said book block and said head so that said other portion of said head end face is stepped back from the spine of said book block;

(e) said opening being in communication with the molten adhesive in said chamber; and (f) a pump for dispensing molten adhesive from said chamber for application to said spine of said book block as said head and said book block are moved relative to one another;

(g) said head being rotatable about an axis substantially perpendicular to said spine of said book block between a first position in which said opening is oriented generally perpendicular to said spine and an angled position in which said opening is angled diagonally across said spine where said opening is of a length sufficient so as to extend across substantially the thickness of said spine of said maximum thickness book block so that adhesive may be applied to the spine of a book block having a thickness equal to said maximum thickness and so that with said head at said angled position, said opening extends diagonally across the spine of a book block having a thickness less than said maximum thickness.

6. Apparatus as set forth in claims 5 wherein the distance that said one portion of said head extends axially out beyond said other portion of said head determines the thickness of said adhesive applied to said spine.

7. Apparatus as set forth in claim 5 wherein said opening is a slot extending diametrically across the end face of said head and wherein said angled position of said slot ranges between about 0° and about 45° from said first position.

8. Apparatus as set forth claim 5 wherein said solid adhesive member is an elongate member, and wherein said apparatus has a positive feed which advances said adhesives member to said head such that said adhesive member constitutes said pump.

9. Apparatus as set forth in claim 8 wherein said positive feed comprises one or more drive members in driving engagement with said adhesive member so as to feed said adhesive member into said chamber at a rate sufficient to insure that said chamber has a sufficient supply of molten adhesive so that a sufficient quantity of said molten adhesive is dispensed from said chamber so as to apply said adhesive to said spine.

10. Apparatus as set forth in claim 8 wherein said positive feed is further operable so as to at least partially withdraw said adhesive member from said chamber so as to effect termination of dispensing of adhesive.

11. Apparatus as set forth in claim 5 wherein said head has a first gage pin disposed adjacent one end of said slot, said first gage pin being positioned proximate one surface of said book block adjacent said spine as said book block and said head are brought into engagement with one another.

12. Apparatus as set forth in claim 10 wherein said head has a second gage pin adjacent the opposite end of said slot with the distance between said gage pins being somewhat greater than said maximum thickness of the thickest book block within said limited range of thicknesses of said book blocks.

13. Apparatus as set forth in claim 11 wherein said opening is a slot extending diametrically across the end face of said head, and wherein upon rotation of said head from its first to said angled position, said first gage pin is moved into engagement said one surface of said book block and said second gage pin is moved into engagement with the other surface of said book block with said slot angling diagonally across the thickness of said spine for the application of adhesive thereto.

14. Apparatus as set forth in claim 13 wherein said heater is comprised of a pair of rod electric heaters,

15. Apparatus as set forth in claim 14 wherein said rod heaters are spaced from one another and each of said rod heaters has an outer end portion extending out beyond the end face of said head and thus constituting said gage pins.

16. Apparatus as set forth in claim 5 wherein with a book block in register with said end face of said head, said head being movable in a direction parallel to said axis toward and away from said spine of said book block between a retracted position in which said end face is clear of the spine of the book block and an operative position in which said one portion of said end face of said head is in operative engagement with said spine.

17. Apparatus as set forth in claim 16 further comprising a motor operatively connected to said head for moving said head between its said retracted and operative positions.

18. Apparatus as set forth in claim 5 further comprising a programmable controller for controlling operation of said apparatus, wherein data regarding the thickness and length of said spine is supplied to said controller, the latter determining the amount of adhesive to be applied to said spine of said book block in proportion to the thickness and length of said spine, said controller effecting the feeding of said adhesive member into said chamber so as to dispense a quantity of said adhesive so that said adhesive will be substantially uniformly applied to said spine upon relative movement of said book block and said head.

19. Apparatus as set forth in claim 18 wherein said controller effects the axial movement of said head from said retracted position to said operative position, effects said relative movement of said applicator and said book block along said patent, and effects the dispensing of adhesive from said head onto said spine.

20. Apparatus as set forth in claim 19 wherein said supply of adhesive is in the form of an elongate adhesive member which is solid at room temperature, said apparatus having a positive feed which advances said adhesive member into said chamber in said head, said positive feed being under the control of said controller for effecting dispensing melted adhesive from said head to said opening and onto said spine.

21. Apparatus as set forth in claim 20 wherein said positive feed comprises at least one drive member in engagement with said adhesive member so as to feed said adhesive member into said chamber to be melted therein.

22. Apparatus as set forth in claim 21 wherein upon completion of application of said adhesive to said spine of said book block, said adhesive member is partially withdrawn from said head thereby to terminate the flow of adhesive from said head.

23. Apparatus as set forth in claim 18 wherein said opening is a slot extending diametrically across the end face of said head, and wherein said apparatus further comprises a motor under the control of said controller for rotating said head from said initial position to an angled position with respect to said spine such that said slot extends diagonally across said spine so that said slot is fully covered by said spine.

24. Apparatus as set forth in claim 23 wherein said head has a first gage pin adjacent one end of said slot for engaging one face of said book block proximate said spine when said head is rotated to its operative position.

25. Apparatus as set forth in claim 24 wherein said head has a second gage pin adjacent the other end of said slot for engaging the other face of said book block proximate said spine when said head is rotated to its operative position.

26. Apparatus as set forth in claim 18 wherein said head is mounted for movement along a path substantially parallel to said spine of said book so as to apply said adhesive to said spine.

27. Apparatus as set forth in claim 26 wherein said head is mounted on one or more rails extending substantially parallel to said spine of said book.

28. Apparatus as set forth in claim 18 further comprising an actuator for application of said adhesive to said spine of said book block, said actuator being under the control of said controller.

29. Apparatus as set forth in claim 18 wherein said supply of adhesive is in the form of an elongate adhesive member which is a solid at room temperature, said apparatus having a positive feed which advances said adhesive member to said heater, said positive feed being under the control of said controller for advancing an amount of said adhesive member into said chamber and for dispensing adhesive from said head and onto said spine.

30. Apparatus as set forth in claim 29 further comprising a drive wheel in gripping engagement with said adhesive member, said drive wheel being driven by a motor under the control of said controller.

31. Apparatus as set forth in claim 30 wherein a gear train is interposed between said motor and said drive wheel.

32. Apparatus as set forth in claim 29 whereupon the completion of dispensing of said adhesive, said elongate adhesive member being partially withdrawn from said head so as to terminate the dispensing of melted adhesive from said head.

33. Apparatus as set forth in claim 29 wherein said heater is capable of melting said adhesive member fed into said head in a time so as to insure that there is a sufficient supply of melted adhesive in said head for the binding of the next book block to be bound.

34. Apparatus for applying adhesive to the spine of a book block of a book so that said book block may have a cover adhesively bound thereto along said spine, said book block having its spine exposed, said apparatus comprising a head, said book block and said head being movable relative to one another toward and away from one another between an adhesive applying position in which said head is in operative relation with said spine so as to apply said adhesive to said spine and a retracted position in which said head is clear of said spine and being movable relative to one another along a path substantially parallel to said spine of said book block, a heater for heating said adhesive to a flowable state for application to said spine, said adhesive being a solid member when at room temperature, and a dispenser for selectively dispensing adhesive from said head so as to apply said adhesive to said spine as said book block and said head are moved relative to one another along said path, wherein said heater heats said head to an elevated temperature, and wherein when said head and said book block are in said adhesive applying position, said heated head at least in part heats said spine so as to result in an improved wetting of the adhesive as the adhesive is applied by the head to the spine.

* * * * *